US008314738B2

(12) United States Patent
Qi et al.

(10) Patent No.: US 8,314,738 B2
(45) **Date of Patent: *Nov. 20, 2012**

(54) MOBILE WIRELESS COMMUNICATIONS DEVICE INCLUDING ELECTRICALLY CONDUCTIVE, ELECTRICALLY FLOATING BEAM SHAPING ELEMENTS AND RELATED METHODS

(75) Inventors: Yihong Qi, St. Agatha (CA); Ying Tong Man, Waterloo (CA); Perry Jarmuszewski, Waterloo (CA); Dietmar Wennemer, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/189,729

(22) Filed: Jul. 25, 2011

(65) Prior Publication Data

US 2011/0279328 A1 Nov. 17, 2011

Related U.S. Application Data

(63) Continuation of application No. 12/499,143, filed on Jul. 8, 2009, now Pat. No. 7,990,323, which is a continuation of application No. 11/766,339, filed on Jun. 21, 2007, now Pat. No. 7,573,427.

(51) Int. Cl.
*H01Q 1/24* (2006.01)
*H01Q 19/00* (2006.01)

(52) U.S. Cl. ..... 343/702; 343/833; 343/834

(58) Field of Classification Search ..... 343/700 MS, 343/702, 818, 833, 834
See application file for complete search history.

(56) References Cited

U.S. PATENT DOCUMENTS

| | | | | |
|---|---|---|---|---|
| 4,864,320 | A | 9/1989 | Munson et al. | 343/833 |
| 6,028,555 | A | 2/2000 | Harano | 343/702 |
| 6,281,843 | B1 | 8/2001 | Evtioushkine et al. | 343/700 |
| 6,288,682 | B1 * | 9/2001 | Thiel et al. | 343/702 |
| 6,392,599 | B1 | 5/2002 | Ganeshmoorthy et al. | 343/700 MS |
| 6,741,215 | B2 | 5/2004 | Grant et al. | 343/702 |

(Continued)

FOREIGN PATENT DOCUMENTS

EP 1359639 11/2003

(Continued)

OTHER PUBLICATIONS

Ha et al., "A modified quasi-yagi planar antenna with wideband characteristics in c-band", IEEE, Jul. 2001, pp. 154-157.

*Primary Examiner* — Michael C Wimer
(74) *Attorney, Agent, or Firm* — Allen, Dyer, Doppelt, Milbrath & Gilchrist, P.A.

(57) ABSTRACT

A mobile wireless communications device may include a portable housing, a printed circuit board (PCB) carried within the portable housing, wireless transceiver circuitry carried by the PCB within the portable housing, and an antenna carried by the PCB within the portable housing and connected to the wireless transceiver circuitry. The device may further include a first pair of electrically floating, electrically conductive, spaced apart, antenna beam shaping elements adjacent the antenna and spaced apart therefrom. A second pair of electrically floating, electrically conductive, spaced apart, antenna beam shaping elements may be adjacent the antenna and spaced apart therefrom. The first pair of antenna beam shaping elements may be positioned in an offset relationship relative to the second pair of antenna beam shaping elements.

23 Claims, 4 Drawing Sheets

U.S. PATENT DOCUMENTS

| | | | | |
|---|---|---|---|---|
| 6,765,536 | B2 | 7/2004 | Phillips et al. | 343/702 |
| 6,795,021 | B2 | 9/2004 | Ngai et al. | 343/700 MS |
| 7,423,605 | B2 | 9/2008 | Qi et al. | 343/818 |
| 7,573,427 | B2 * | 8/2009 | Qi et al. | 343/702 |
| 7,812,770 | B2 | 10/2010 | Qi et al. | 343/702 |
| 7,990,323 | B2 * | 8/2011 | Qi et al. | 343/702 |
| 2005/0162327 | A1 | 7/2005 | Mori | 343/770 |

FOREIGN PATENT DOCUMENTS

| | | |
|---|---|---|
| EP | 1475858 | 10/2004 |
| GB | 2340309 | 2/2000 |
| WO | 03/085778 | 10/2003 |
| WO | 2004/021511 | 3/2004 |

* cited by examiner

MOBILE WIRELESS COMMUNICATIONS DEVICE INCLUDING ELECTRICALLY CONDUCTIVE, ELECTRICALLY FLOATING BEAM SHAPING ELEMENTS AND RELATED METHODS

RELATED APPLICATIONS

This application is a continuation of Ser. No. 12/499,143 filed Jul. 8, 2009, now U.S. Pat. No. 7,990,323 which, in turn, is a continuation of Ser. No. 11/766,339 filed Jun. 21, 2007 now U.S. Pat. No. 7,573,427 issued Aug. 11, 2009, all of which are hereby incorporated herein in their entireties by reference.

FIELD OF THE INVENTION

The present invention relates to the field of communications devices, and, more particularly, to mobile wireless communications devices and related methods.

BACKGROUND

Cellular communications systems continue to grow in popularity and have become an integral part of both personal and business communications. Cellular telephones allow users to place and receive voice calls most anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for the antenna.

One approach for reducing phone size is to use flip phones having top and bottom housings connected with a hinge. The housings may be closed when the phone is not in use so that it is more compact and easier for a user to carry. One exemplary antenna system for a flip style cellular phone is described in U.S. Pat. No. 6,765,536. In particular, the antenna system includes an external antenna element carried on the top of the lower housing, and a parasitic element carried by the top housing so that when the phone is flipped open the parasitic element is in close proximity to the antenna element. A tuning circuit carried by the lower housing is electrically coupled to the parasitic element. The tuning circuit is variable to adjust the parasitic load on the antenna element to provide variable operating frequencies and bandwidths for the phone.

External cell phone antennas are advantageous in that they are spaced apart from the user's head, which makes it easier for phone manufacturers to comply with applicable specific absorption rate (SAR) requirements, for example. This is because the farther the radiating element of the cell phone antenna system is from the user, the less intense the radiation exposure to the user. Yet, many users prefer internal antennas over external antennas, as external antennas are prone to catch on objects and become damaged, for example. Yet, with the ever increasing trend towards smaller cell phone sizes, for a relatively small phone having an internal antenna, this may place the antenna in relatively close proximity to the user's ear, which may make complying with applicable SAR and/or hearing aid compatibility (HAC) requirements potentially difficult for manufacturers.

One exemplary mobile phone configuration that attempts to address radiation concerns from an internal antenna is set forth in PCT Publication No. WO/2004/021511 A2. The device includes a casing including a first in-built driven antenna element extending a length along a longest side of the casing. Either the portable communication device or the case includes at least one passive beam directive element distanced from and generally extending along at least most of the same length as the first in-built driven antenna element. Because of this, electromagnetic radiation generated by the first in-built driven antenna element is enhanced in a direction away from a side of the casing intended to be facing a user.

Despite the existence of such configurations, further improvements may be desirable in certain applications, particularly where the form factor of the device housing does not provide adequate space for such arrangements.

DETAILED DESCRIPTION OF THE PREFERRED EMBODIMENTS

Figure 1:
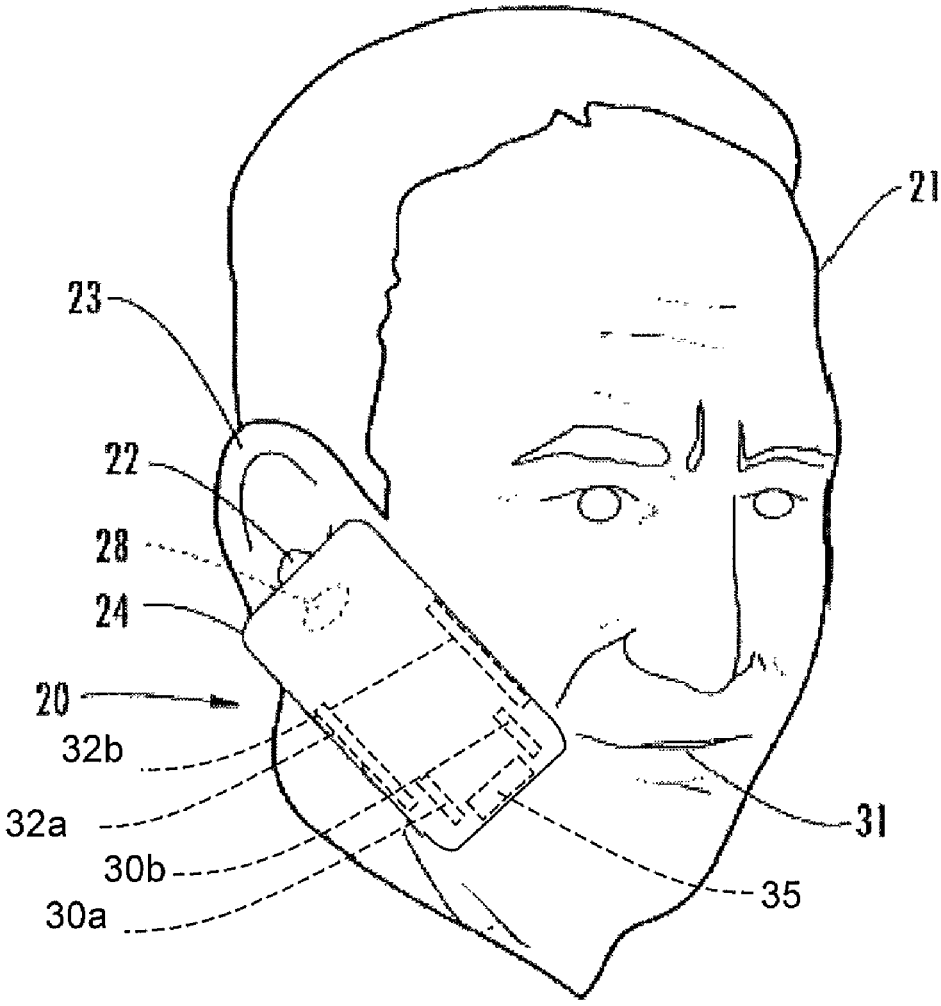
FIG. 1 is a perspective view of a mobile wireless communications device in accordance with one exemplary embodiment next to a user wearing an electronic hearing aid.
Figure 2:
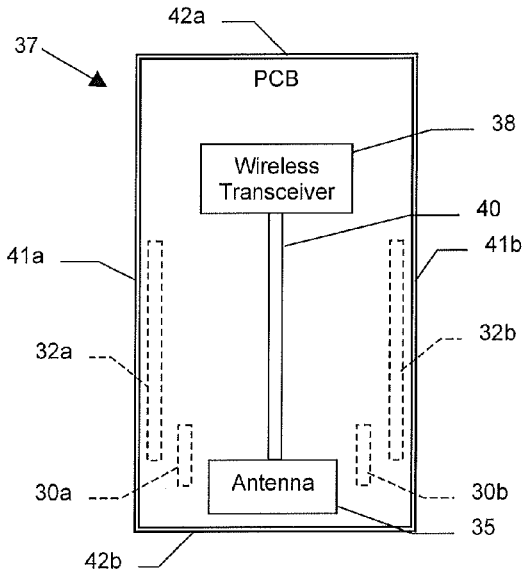
FIG. 2 is a schematic front view of the PCB and electrically floating, electrically conductive antenna beam shaping elements of the mobile wireless communications device of FIG. 1.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout, and prime notation is used to indicate similar elements in alternative embodiments.

Generally speaking, a mobile wireless communications device is disclosed herein which may include a portable housing, a printed circuit board (PCB) carried within the portable housing, wireless transceiver circuitry carried by the PCB within the portable housing, and an antenna carried by the PCB within the portable housing and connected to the wireless transceiver circuitry. The device may further include a first pair of electrically floating, electrically conductive, spaced apart, antenna beam shaping elements adjacent the antenna and spaced apart therefrom. In addition, a second pair of electrically floating, electrically conductive, spaced apart, antenna beam shaping elements may be adjacent the antenna and spaced apart therefrom. More particularly, the first pair of antenna beam shaping elements may be positioned in an offset relationship relative to the second pair of antenna beam shaping elements.

Each of the first pair of antenna beam shaping elements may have a first length, and each of the second pair of antenna beam shaping elements may have a second length greater than the first length. Additionally, the first and second pairs of beam shaping elements may each be symmetrically positioned with respect to the antenna.

In accordance with one aspect, the first pair of antenna beam shaping elements may be positioned in a vertically offset relationship relative to the second pair of antenna beam shaping elements. More particularly, the first and second pairs of beam shaping elements may at least partially overlap.

The first and second pairs of beam shaping elements may also be co-planar in some embodiments. Furthermore, the first pair of antenna beam shaping elements may be positioned in a laterally offset relationship relative to the second pair of antenna beam shaping elements. Also, the first pair of antenna beam shaping elements may have respective ends extending beyond respective ends of the second pair of antenna beam shaping elements.

At least one of the first and second pairs of beam shaping elements may be secured to a surface of the portable housing, for example. Furthermore, each of the antenna beam shaping elements may comprise at least one generally rectangular metal layer. In addition, mobile wireless communications device may further include a battery carried within the portable housing and connected to the PCB, and the portable housing may comprise a battery access panel to which at least one of the first and second pairs of beam shaping elements is secured. Also, the PCB may have a top portion and a bottom portion, and the antenna may be carried by the bottom portion of the PCB.

Referring initially to FIGS. 1 through 4, a mobile wireless communications device, such as a cellular telephone 20, is for a user 21. In some applications, the user 21 may be wearing an electronic hearing aid 22 in an ear 23 of the user. In particular, the cellular telephone 20 may advantageously provide desired hearing aid compatibility (HAC) for users with hearing aids in some implementations, as will be discussed further below, but need not be used with hearing aids in all embodiments.

The cellular telephone 20 illustratively includes a portable housing 24 and an audio output transducer 28 (e.g., a speaker) carried by the housing and accessible to the electronic hearing aid 22 of the user 21 adjacent the top of the housing as shown. An audio input transducer (e.g., microphone) is also carried by the housing 24 and accessible to a mouth 31 of the user 21 adjacent the bottom of the housing. Although described herein with reference to a cellular device, it should be noted that the present disclosure may be applicable to other wireless communications devices such as wireless LAN devices, etc.

The cellular telephone 20 further illustratively includes a printed circuit board (PCB) 37 carried by the housing 24, and an antenna 35 and a wireless (e.g., cellular) transceiver 38 carried on a front and/or back surface of the PCB. Of course, these components may be carried on the back surface or in positions other than those shown in other embodiments. The PCB 37 further illustratively includes an antenna feed line 40 connecting the antenna 35 to the wireless transceiver 38. By way of example, the antenna 35 may be formed by a plurality of conductive traces on the PCB 37 and may take the form of one or more single or multi-feed point antenna elements (monopole, inverted F, etc., for example, as will be appreciated by those skilled in the art. The cellular telephone 20 may further include other components connected to the PCB 37 such as a display, battery 53 (FIG. 4), keypad, processing circuitry, etc., as will be discussed further below.

In the present example, the antenna 35 is positioned adjacent a bottom 42*b* of the PCB 37 and therefore the bottom of the housing 24 (i.e., where the input microphone is), which advantageously helps reduce coupling to the electronic hearing aid 22 of the user 21 with respect to traditional top-mounted, internal cellular phone antennas. The PCB 37 also has left and right sides 41*a*, 41*b* as well as a top 42*a*. This is because the electronic hearing aid 22 of the user 21 is advantageously further separated from the antenna 35 when the cellular telephone 20 is held adjacent the user's ear 23 than would otherwise be the case with a typical top-mounted, internal cellular telephone antenna, for example. Moreover, this antenna placement also helps space the antenna 35 farther apart from the user's brain, which in turn helps to reduce the SAR of the cellular telephone 20 again with a respect to a traditional top-mounted, internal cellular phone antenna. However, it should be noted that a top-mounted or other antenna placement may be used in some embodiments.

Nonetheless, if the portable housing 24 has a relatively small form factor or footprint for user convenience, this means that the antenna 35 may still be positioned relatively close to the user's ear 23, thus potentially elevating the SAR or coupling to the hearing aid 22 to unacceptable levels. As such, the cellular telephone 20 may therefore advantageously include first and second pairs of electrically floating, electrically conductive, antenna beam shaping elements 30*a*, 30*b* and 32*a*, 32*b* for helping to direct the beam pattern of the antenna 35 away from the user and the hearing aid 22, as will be appreciated by those skilled in the art. The first and second pairs of beam shaping elements 30*a*, 30*b* and 32*a*, 32*b* advantageously define a two-stage antenna coupling configuration. It should be noted that additional pairs of beams shaping elements may also be used in some embodiments.

Generally speaking, the first pair of antenna beam shaping elements 30*a*, 30*b* are positioned in an offset relationship relative to the second pair of antenna beam shaping elements 32*a*, 32*b*. In the present example, the two pairs are laterally offset from one another. That is, they are laterally offset or spaced apart from one another from left to right in the plane of the page. Moreover, the first and second pairs of antenna beam shaping elements 30*a*, 30*b* and 32*a*, 32*b* may be co-planar, e.g., on a same side of the PCB 37 (which may or may not be the same side of the PCB that the antenna 35 is on), on a same surface of the portable housing 24, etc. In other embodiments, the first and second pairs of antenna beam shaping elements 30*a*, 30*b* and 32*a*, 32*b* may be on different sides of the PCB 37, or one may be positioned on the PCB and the other carried on a surface of the housing 24, for example. Other configurations are also possible, as will be appreciated by those skilled in the art, and as will be discussed further below.

Figure 3:
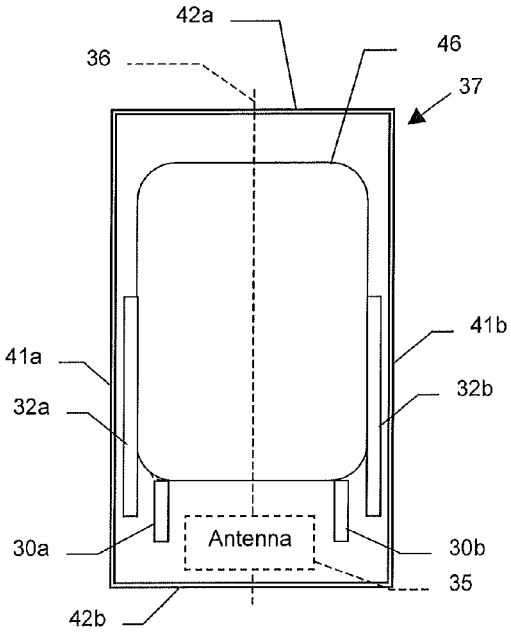
FIG. 3 is a schematic rear view of the PCB and electrically floating, electrically conductive antenna beam shaping elements of the mobile wireless communications device of FIG. 1.

By way of example, the first and second pairs of antenna beam shaping elements 30*a*, 30*b* and 32*a*, 32*b* may be symmetrically positioned with respect to the antenna 35. More particularly, the present example each of the first and second pairs of antenna beam shaping elements 30*a*, 30*b* and 32*a*, 32*b* are positioned substantially parallel to a longitudinal axis 36 of the portable housing, as shown in FIG. 3, although other placements may also be possible in different embodiments, as will be appreciated by those skilled in the art.

Each of the first pair, of antenna beam shaping elements 30*a*, 30*b* may have a first length, and each of the second pair of antenna beam shaping elements 32*a*, 32*b* may have a second length. In the illustrated embodiment, the second length is greater than the first length, although it could be the opposite in other embodiments (or the first and second lengths could be the same). By way of example, each beam shaping element 30*a*, 30*b*, 32*a*, 32*b* may have a width in a range of about 2 to 15 mm, and a length in a range of about 1 to 10 cm, although other sizes may also be used in some embodiments.

As will be appreciated by those skilled in the art, the size, number, and placement of the first and second pairs of antenna beam shaping elements 30*a*, 30*b* and 32*a*, 32*b* will have an effect on the performance of the antenna 35. Thus, the particular size/number/placement selection may vary depending upon the given implementation and the applicable antenna performance characteristics. It should also be noted that the second pair of beam shaping 32*a*, 32*b* need not be longer than the first pair in all embodiments (i.e., the pairs may be the same length or the second pair shorter than the first).

Figure 4:
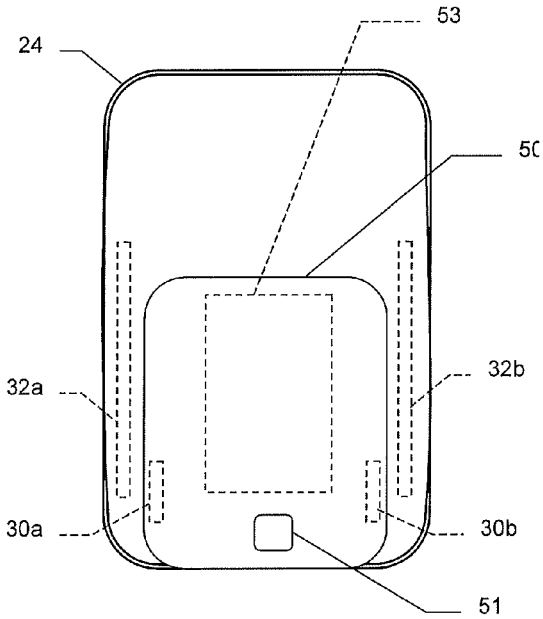
FIG. 4 is a schematic rear view of the portable housing and removable battery access panel of the mobile wireless communications device of FIG. 1.

As shown in FIG. 4, the cellular telephone 20 illustratively includes a battery 53 carried within the portable housing 24 and removably connected to the PCB 37, and a removable access panel 50 provides access to the battery. A release button or catch 51 (or other suitable element) may be included for securing the panel 50 in place. In the illustrated embodiment, the first pair of antenna beam shaping elements 30*a*, 30*b* is secured to the inner surface of the removable access panel 50, and the second pair of beam shaping elements 32*a*, 32*b* are carried on the inner surface of the back side of the portable housing directly adjacent the removable access panel. The use of such a two-stage beam shaping element configuration advantageously allows the configuration to be adapted to different form factors and housing shapes/sizes. That is, the first and second pairs of beam shaping elements 30*a*, 30*b* and 32*a*, 32*b* can advantageously be positioned to accommodate different shapes and sizes of battery access panels 50 and form factors, as will be appreciated by those skilled in the art. In some embodiments, one or both pairs of the beam shaping elements may also be positioned on the sides of the housing 24.

In the exemplary embodiment, the beam shaping elements 30*a*, 30*b* and 32*a*, 32*b* are generally rectangular metal layers that are secured to the inner surfaces of the access panel 50 and portable housing 24, respectively, with an adhesive layer. However, the beam shaping elements 30*a*, 30*b* and 32*a*, 32*b* may take different shapes in different embodiments, and may be secured to the housing 24, access panel 50, PCB 37, etc. by suitable methods of attachment other than an adhesive. For example, the beam shaping elements 30*a*, 30*b* may be printed on the housing/access panel/PCB with conductive ink, similar to conductive circuit traces on a circuit board, as will be appreciated by those skilled in the art.

In some embodiments, it may be desirable to place a cover layer (not shown) on or more of the beam shaping elements 30*a*, 30*b*, 32*a*, 32*b*, and particularly if the element(s) is going to be placed on an outside surface of the portable housing 24. The cover layer may be a dielectric layer, such as a dielectric tape layer, for example. The cover layer(s) may advantageously help protect the beam shaping elements so that they are not damaged or altered such that SAR and/or HAC performance is potentially degraded. Moreover, the cover layer(s) may also advantageously conceal the beam shaping elements, for example, by making the cover layer the same color as a color of the portable housing 24 and/or the access panel 50, as will be appreciated by those skilled in the art.

Figure 5:
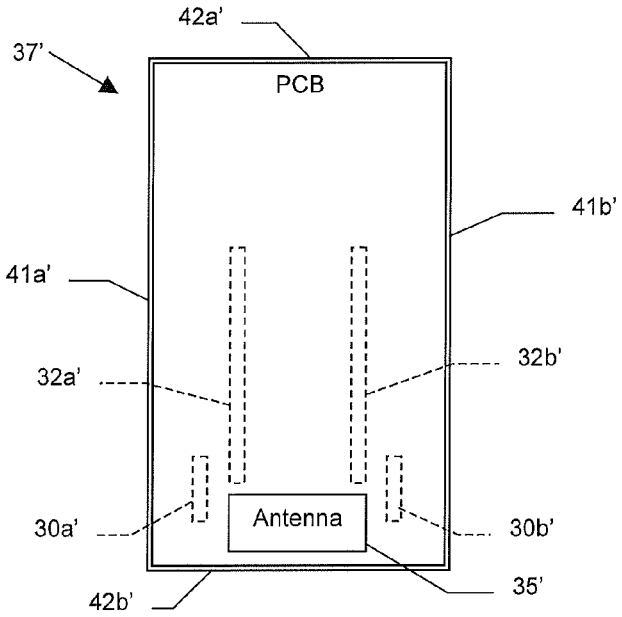
FIG. 5 is a schematic front view of the PCB and electrically floating, electrically conductive antenna beam shaping elements of an alternative embodiment of the mobile wireless communications device of FIG. 1.

Referring now to FIG. 5, an alternative embodiment is shown in which the second pair of beam shaping elements 32*a*', 32*b*' are positioned between the first pair of beam shaping elements. As can be seen in the present embodiment and the embodiment discussed above, the first pair of beam shaping elements 30*a*', 30*b*' have respective ends that extend beyond respective ends of the second pair of beam shaping elements 32*a*', 32*b*'. However, in some embodiments the ends may be co-terminus, or the ends need not extend all the way to one another.

Figure 6:
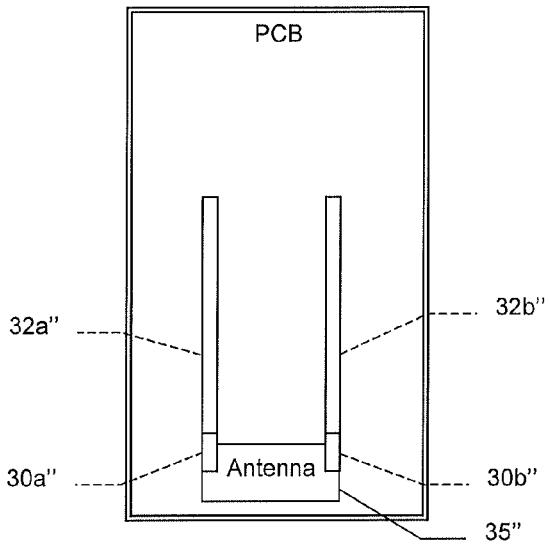
FIG. 6 is a schematic front view of the PCB and electrically floating, electrically conductive antenna beam shaping elements of yet another alternative embodiment of the mobile wireless communications device of FIG. 1.
Figure 7:
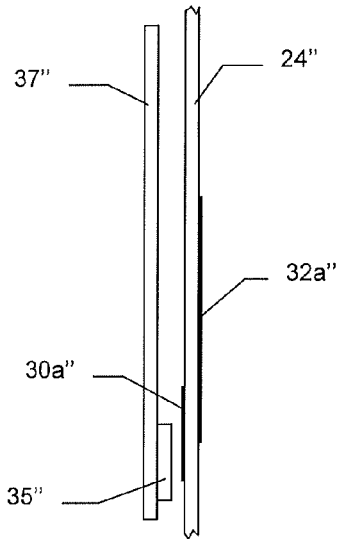
FIG. 7 is a side view of the PCB and electrically floating, electrically conductive antenna beam shaping elements of the device of FIG. 6.

Still another alternative embodiment is now described with reference to FIGS. 6 and 7. Here, the first pair of beam shaping elements 30*a*", 30*b*" are positioned in a vertically offset relationship relative to the second pair of beam shaping elements 32*a*", 32*b*", as perhaps best seen in FIG. 7. Stated alternatively, the first pair of beam shaping elements 30*a*", 30*b*" are positioned vertically above the antenna 35", and the second pair of beam shaping elements 32*a*", 32*b*" are positioned vertically above the first pair of beam shaping elements.

In the illustrated example, this is accomplished by positioning the first pair of beam shaping elements 30*a*", 30*b*" on the inner surface of the front side of the portable housing 24", and the second pair of beam shaping elements 32*a*", 32*b*" is positioned on the outer surface of the front side of the portable housing, as shown. However, in other embodiments the first and/or second pairs of beam shaping elements 30*a*", 30*b*" and 32*a*", 32*h*" could be positioned vertically beneath the antenna 35" (e.g., on the back side of the PCB 37" and/or inner/outer surfaces of the back side of the portable housing 24"). In the present example, the first and second pairs of beam shaping elements 30*a*", 30*b*" and 32*a*", 32*b*" also partially overlap, but as noted above an overlap is not required in all embodiments.

Other exemplary components of a hand-held mobile wireless communications device 1000 are now described in the example below with reference to FIG. 8. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 8:
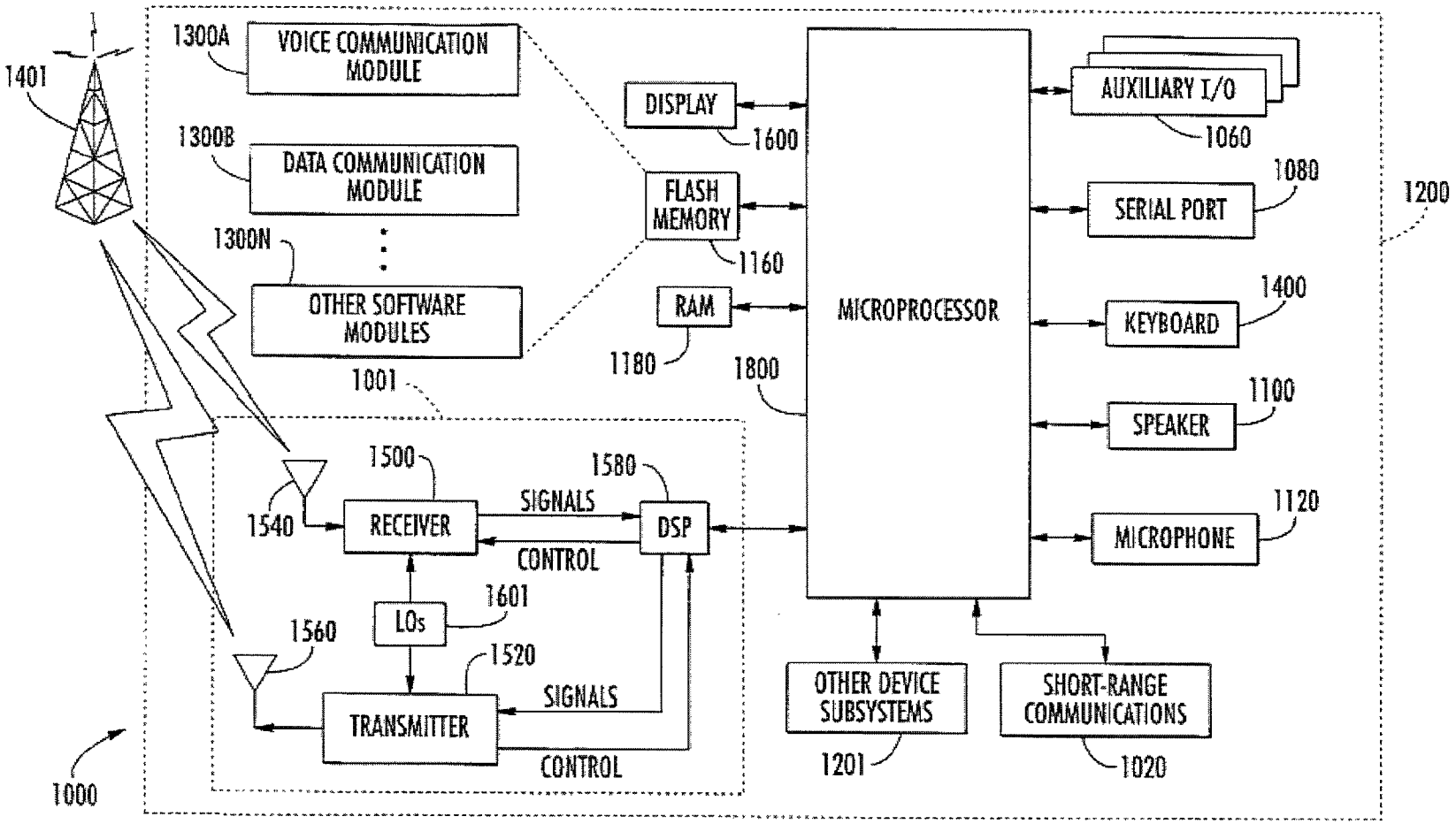
FIG. 8 is a schematic block diagram illustrating additional exemplary components of the mobile wireless communications device of FIG. 1.

In addition to the processing device 1800, other parts of the mobile device 1000 are shown schematically in FIG. 8. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIM data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. An electronic device comprising:

a housing;

wireless circuitry carried by said housing;

an antenna connected to said wireless circuitry;

at least one first pair of electrically floating, spaced apart electrical conductors adjacent said antenna and spaced apart therefrom;

at least one second pair of electrically floating, spaced apart electrically conductors adjacent said at least one first pair of electrically floating, spaced apart electrical conductors and spaced apart therefrom; and said at least one second pair of electrically floating, spaced apart electrically conductors also being spaced apart from said antenna a greater distance than said at least one first pair of electrically floating, spaced apart electrical conductors.

2. The electronic device of claim 1 wherein each of said first pair of electrical conductors has a first length; and wherein each of said second pair of electrical conductors has a second length greater than the first length.

3. The electronic device of claim 1 wherein said first and second pairs of electrical conductors are each symmetrically positioned with respect to said antenna.

4. The electronic device of claim 1 wherein said first pair of electrical conductors is positioned in a vertically offset relationship relative to said second pair of electrical conductors.

5. The electronic device of claim 1 wherein said first and second pairs of electrical conductors at least partially overlap.

6. The electronic device of claim 1 wherein said first and second pairs of electrical conductors are co-planar.

7. The electronic device of claim 1 wherein said first pair of electrical conductors is positioned in a laterally offset relationship relative to said second pair of electrical conductors.

8. The electronic device of claim 7 wherein said first pair of electrical conductors has respective ends extending beyond respective ends of said second pair of electrical conductors.

9. The electronic device of claim 1 wherein said at least one first pair of electrically floating, spaced apart electrical conductors and said at least one second pair of electrically floating, spaced apart electrically conductors are each secured to a surface of said housing.

10. The electronic device of claim 1 wherein said at least one first pair of electrically floating, spaced apart electrical conductors and said at least one second pair of electrically floating, spaced apart electrically conductors each comprises at least one generally rectangular metal layer.

11. The electronic device of claim 1 further comprising a battery carried within said housing; and wherein said housing comprises a battery access panel to which said at least one first pair of electrically floating, spaced apart electrical conductors and said at least one second pair of electrically floating, spaced apart electrically conductors are each secured.

12. The electronic device of claim 1 wherein said housing has a top portion and a bottom portion; and wherein said antenna is carried adjacent the bottom portion of said housing.

13. An electronic device comprising:

a housing;

wireless circuitry carried by said housing;

an antenna connected to said wireless circuitry;

at least one first passive antenna beam shaping arrangement adjacent said antenna and spaced apart therefrom;

at least one second passive antenna beam shaping arrangement adjacent said at least one first passive antenna beam shaping arrangement and spaced apart therefrom; and said at least one second passive antenna beam shaping arrangement also being spaced apart from said antenna a greater distance than said at least one first passive antenna beam shaping arrangement;

each of said first and second at least one passive beam shaping arrangements comprising a plurality of electrical conductors positioned on said housing.

14. The electronic device of claim 13 wherein said at least one first passive antenna beam shaping arrangement comprises a first pair of electrically floating, spaced apart electrical conductors; and wherein said at least one second passive antenna beam shaping arrangement comprises a second pair of electrically floating, spaced apart electrically conductors.

15. The electronic device of claim 14 wherein each of said first pair of electrical conductors has a first length; and wherein each of said second pair of electrical conductors has a second length greater than the first length.

16. The electronic device of claim 14 wherein said first and second pairs of electrical conductors are each symmetrically positioned with respect to said antenna.

17. The electronic device of claim 14 wherein said first pair of electrical conductors is positioned in a vertically offset relationship relative to said second pair of electrical conductors.

18. The electronic device of claim 14 wherein said first and second pairs of electrical conductors at least partially overlap.

19. The electronic device of claim 14 wherein said first and second pairs of electrical conductors are co-planar.

20. The electronic device of claim 14 wherein said first pair of electrical conductors is positioned in a laterally offset relationship relative to said second pair of electrical conductors.

21. The electronic device of claim 20 wherein said first pair of electrical conductors has respective ends extending beyond respective ends of said second pair of electrical conductors.

22. A method of making a mobile wireless communications device comprising:

positioning an antenna within a housing and connected to wireless circuitry; and positioning at least one first pair of electrically floating, spaced apart electrical conductors adjacent the antenna and spaced apart therefrom; and positioning at least one second pair of electrically floating, spaced apart electrically conductors adjacent the at least one first pair of electrically floating, spaced apart electrical conductors and spaced apart therefrom, the at least one second pair of electrically floating, spaced apart electrically conductors also spaced apart from the antenna a greater distance than the at least one first pair of electrically floating, spaced apart electrical conductors.

23. The method of claim 22 wherein the first pair of electrical conductors is positioned in a vertically offset relationship relative to the second pair of electrical conductors.

* * * * *